United States Patent [19]

Egger

[11] 4,194,855

[45] Mar. 25, 1980

[54] METHOD FOR STORING WASTE MATERIALS AND THEIR COMBUSTION RESIDUES IN A MANNER HARMLESS TO UNDERGROUND WATER

[76] Inventor: Hanns Egger, Haus Nr. 44, 8110 Hagen bei Murnau, Fed. Rep. of Germany

[21] Appl. No.: 890,291

[22] Filed: Mar. 27, 1978

[51] Int. Cl.[2] ..... E02D 3/00

[52] U.S. Cl. ..... 405/128; 210/1; 405/258

[58] Field of Search ..... 61/0.5, 1 R, 35; 405/128, 129, 258; 210/1, 59

[56] References Cited

U.S. PATENT DOCUMENTS

| | | | |
|---|---|---|---|
| 3,461,673 | 8/1969 | Slover | 61/1 R |
| 3,474,625 | 10/1969 | Draper et al. | 61/1 R |
| 3,586,624 | 6/1971 | Larson | 61/35 X |
| 3,705,851 | 12/1972 | Brauer | 61/35 X |
| 3,782,299 | 1/1974 | Egger | 110/7 R |

FOREIGN PATENT DOCUMENTS

| | | | |
|---|---|---|---|
| 2430371 | 1/1976 | Fed. Rep. of Germany | 405/128 |

*Primary Examiner*—David H. Corbin

*Attorney, Agent, or Firm*—Hill, Van Santen, Steadman, Chiara & Simpson

[57] ABSTRACT

An earth pit is prepared for the storage of waste materials by lining the bottom of the pit with a layer of finely-ground loose material followed by a synthetic plastic sheet resistant to humus, roots and tearing followed by a second layer of finely-ground loose material. The layers of loose material equalise the pressure on the opposite sides of the synthetic plastic sheet. A number of sheets may be solution-welded together for a large pit.

6 Claims, 1 Drawing Figure

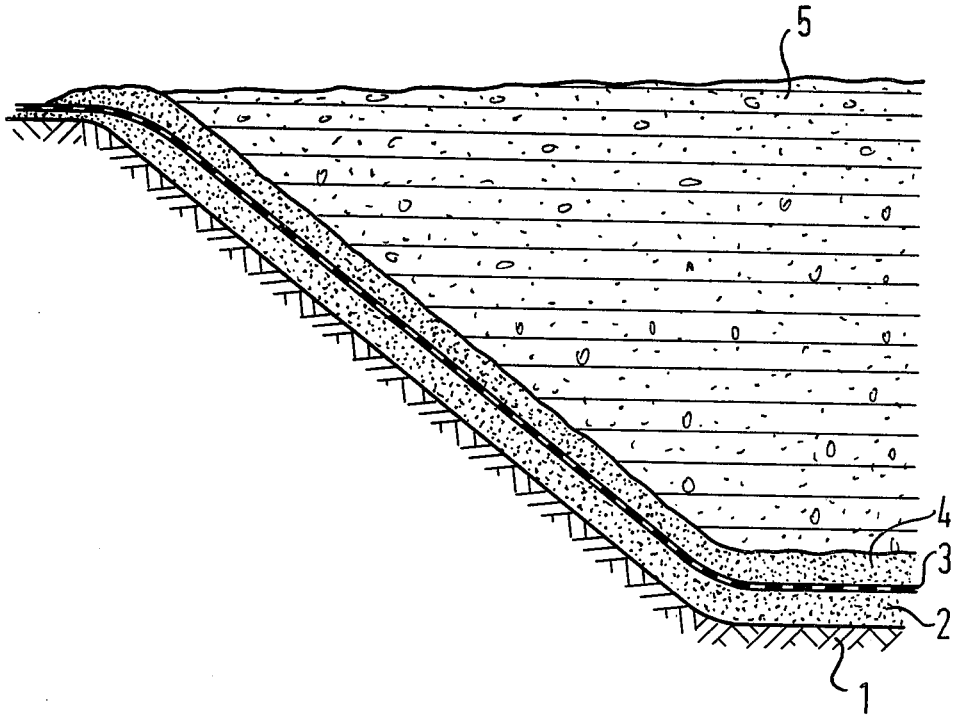
5
4
3
2
1

METHOD FOR STORING WASTE MATERIALS AND THEIR COMBUSTION RESIDUES IN A MANNER HARMLESS TO UNDERGROUND WATER

FIELD OF THE INVENTION

This invention relates to a method for storing waste materials such as household refuse, industrial refuse and in particular refuse slag or industrial slag in a manner harmless to underground water.

STATE OF THE ART

As people combine into ever larger communities, the elimination of waste materials of all types, but in particular household and/or industrial refuse, represents an acute problem. A series of methods for solving this problem has been developed. These can be divided substantially into two categories. In one fundamental method, the waste materials, of any origin, are not subjected to any chemical biological or mechanical-physical processing, but instead the only precautions taken are those directed to storing such materials in a manner as harmless as possible to underground water. In such storage methods, importance is also sometimes laid on preventing environmental pollution by the usual odours etc. Such a method is for example described in the U.S. Pat. No. 3,782,299 (H. Egger), in which waste materials of all types are foamed under and over with foam plastics. In a preferred embodiment, the foam plastics should be of a closed cell specification. Although this known method has a number of advantages, it is not able to be used in all cases and under all conditions.

The second method of overcoming the refuse and waste problem, and which in recent times has become ever increasingly used, consists of subjecting such waste materials to mechanical size reduction and then to pyrolisis with an unlimited or limited oxygen feed. Although in some of these methods activated carbon can be obtained in one of the stages from the organic components of the refuse, a considerable quantity of incombustible inorganic material is present, known as industrial slag or refuse slag. Large problems occur in the storage of such slag. The reason for this is that storage dumps must not only satisfy mechanical, i.e., flexibility requirements, but in addition the chemical loading is considerable. In this respect, dynamic stresses occur in storage dumps caused by sinking into the subsoil due to the load on filling, the non-uniform storage level and the compression of the stored material. Moreover, when liquid enters the slag, corrosive fluids are produced which in the main are of basic type. Because of the mechanical stressing and chemical attack, previously known methods the sealing means usually quickly break or trear, leading to a soiling or poisoning of the underground water due to the entry of moisture, e.g. rain water etc. In Swiss Patent specification No. 564 131, a seal is described for dumps comprising sheets laid on the dump floor, wherein a sealing sheet is disposed between sanded roofing felt, acting as the adhesive layer, and an upper sliding layer. The sliding layer likewise consists of a synthetic plastic sheet. The purpose of this is to move with low friction on the sealing sheet, which is provided on its underside with projections and depressions, which form a positive connection with the adhesive layer when under pressure. A protection covering, e.g. of lean concrete or another coarse or hard material, is provided on the upper sheet, i.e., the sliding sheet. This method is as yet unsatisfactory, because the overlying layer of coarse particle material or hard material generally causes tearing and chafing through of the sheet due to the unavoidable rubbing and chafing effects. This result is magnified in that the so-called sealing sheet comprises a lower side containing projections and depressions, so that anisotropic and in particular point-applied loads occur on the sheet, which again lead to its rapid wear.

According to German Gebrauchsmuster No. 6 918 037, a liquid-tight lining for liquids or solids, and which is proposed particularly for refuse pits, can be formed by using a synthetic plastic sheet which at its edge is turned inwards in the form of a loop about a tubular frame, and is firmly joined together in the overlapping region. The sheet is fixed not only by the plastics frame but also by fixing hooks and in particular earth nails. This method has the drawback that those parts of the sheet which lie on the tubular frame are subjected to particular stresses when filling with refuse or slag, so that the mechanical disintegration of the sheet quickly takes place at these parts. With such stresses, in particular when they act obliquely, the sheet is also torn out of the fixing hooks, so that it is possible for corrosive and poisonous liquid to penetrate into the underground water.

OBJECT OF THE INVENTION

The object of the invention is to provide a method of the aforesaid type, which ensures safe storage of waste materials and in particular of slag materials in a simple and inexpensive manner. In this respect, a method is aimed at in particular by which any danger to the underground water by waste liquids is excluded for as long as possible. A further object of the invention is to form the seal by using waste materials themselves, and thus provide a method which in itself is inexpensive and harmless to the environment.

DESCRIPTION OF THE INVENTION

The method according to the invention for storing solid combustion residues, particularly refuse slag and solid industrial slag, in a manner harmless to underground water, is characterised in that earth pits are formed, comprising a humus-resistant, root-resistant solution-weldable synthetic plastic sheet between pressure equalising layers of finely ground loose material, at least one pressure equalising layer being formed from ground slag.

On the one hand, the invention is based on the fact that it is necessary, in order for the sheets to be preserved for many years, to use sheets with very special properties, and in particular humus-resistant, root-resistant and tear-resistant. The synthetic plastic sheet must also be solution-weldable. A further important property which the sheet should possess is chemical resistance, in particular resistance to slkali. Suitable basic sheet materials are in particular polyolefins, such as polyethylene and polypropylene, but also polycarbonate and in particular polyvinylchloride or polyvinylidenechloride sheets are suitable, possibly stablised. Particularly suitable for the purposes of the invention are suitably stabilised PVC sheets, in particular those stabilised with barium/cadmium (compounds). A further important aspect of the present invention is that a directional stressing or loading of the sheet is prevented by means of pressure equalising layers. Such loads can arise from an uneven support surface, overlying layers or filled materials. Small extends of unevenness, coarse materials together with the mechanical loads due to ground sinking, uneven filling of the dump etc. lead to chafing through, tearing and perforation of the sheets. Thus the invention is substantially based on the fact that the special synthetic plastic sheet should be protected both from underneath and from above by pressure equalising layers. These pressure equalising layers can be formed from loose material of very small particle size. In this respect, it is preferable to use loose material which is ground to fine dust or powder form. According to a preferred embodiment of the invention, the finely ground loose material which forms the pressure equalising layers is itself formed from ground refuse slag or industrial slag. In this respect, it is desirable that at least one layer, generally the layer which is laid on the sheet, is formed from ground slag. For this purpose, it is necessary to grind the relatively coarse slag into relatively small particle sizes, e.g. dust or powder fine. In this respect, it is surprisingly possible to use the material occurring in great quantity in refuse processing plants as the sealing medium, thus giving a particularly economical method. This is particularly the case when the dumps are situated directly adjacent to the refuse processing plant.

In the method according to the invention, sheets of any desired surface area can be used. However, if the sheet consists of more than one single sheet, these are preferably solution-welded. By means of the solution-welding method, which is known, an excellent joint can be obtained between the sheets, without the joint positions being more subject to damage by mechanical stressing and/or chemical attack than is the case for the inner regions of the individual surfaces. In such embodiments of the invention, solution welds for larger surfaces are desirably made on the dump site.

The thickness of the pressure equalising layers can be determined in relation to the expected loading with refuse or stored material. Within the scope of the invention, the layer thicknesses used are between about 150 and 500 mm, a preferred layer thickness for the loose material forming the pressure equalising layer being between about 300 and 400 mm. If high loadings are expected, the layer thickness can be correspondingly increased, this also being the case where the material to be stored, on account of its bulky shape, can lead to mechanical damage of the sheet. However, if for example it is required to store, for example in the neighbourhood of refuse processing plants, the industrial slag or refuse slag occurring in large quanitities therein, than for example slag deposits of ground refuse slag of about 150 mm or somewhat less can be used to form pressure equalising layers.

However, the important consideration is that all unevenness on the subsoil of the storage dump must be equalised by the layer of loose material. Although in view of the covering function of the sheet and in view of the upper fine particle pressure equalising layer which covers this latter it is also possible to form the pressure equalising layer under the sheet from ground slag, in the case of certain embodiments it can be preferable to form the lowest layer from a mechanically resistant material present in the required fineness. It is also obviously possible to build up several horizontal storage layers in the form of a chain consisting of a lower pressure equalising layer—cover and sealing sheet—upper pressure equalising layer—stored material (e.g. slag-)—further pressure equalising layer—sealing sheet—further pressure equalising layer—stored material etc. in a horizontal overlying disposition.

The subsoil shaping can be carried out in a conventional manner. In this respect, for example, the following variations can be mentioned:

(1) Excavation to the required size, then levelling the pit floor and possibly consolidating it.

(2) Banking up a closed embankment, the crown width of which allows travel by heavy lorries.

(3) Arranging several deposits in layers above each other.

In order to prevent the filling of a dump by surface water and its overflowing, it is necessary to lead this dirty water off via a clarification plant of known construction.

DESCRIPTION OF THE ILLUSTRATED EMBODIMENT

The invention is further illustrated in the accompanying drawing, which shows a dump sealed by the method according to the invention. This shows the solid ground 1, the lower pressure equalising layer 2, the sheet 3, the upper pressure equalising layer 4, and the stored material 5.

In particular embodiments of the invention, it can be desirable to provide the subsoil with a supplementary protection layer before laying the pressure equalising layer. This can be desirable if the storage of highly toxic waste, such as residues from galvanising works etc., is required. Such a subsoil screening can be obtained by foaming the subsoil at least partly over with foam plastics. It is particularly desirable that the foam plastics material is of closed cell specification, and is, if necessary, made incombustible by the addition of additives.

The invention is illustrated in the example given hereinafter.

EXAMPLE

The pit floor is levelled in a pit located directly adjacent to a refuse processing plant. In excavating the pit, care had already been taken to form a closed embankment system the crown width of which allowed feed vehicles to travel. Industrial slag ground dust fine is laid on the levelled floor to a layer thickness of about 500 mm. PVC sheet stabilised with barius/cadmium is then fitted, having been formed from single sheets solution-welded on site. On this sheet is then laid a pressure equalising layer of ground industrial slag which had been obtained by finely grinding the slag resulting from the refuse processing plant. Material to be stored is then filled into the pit.

I claim:

1. A method for storing waste materials and their combustion residues in a manner harmless to underground water, comprising the steps of: digging a pit providing a bottom; laying a first pressure-equalising layer of finely ground loose material on the bottom of the pit such that the layer covers the bottom of the pit, placing a humus-resistant, root-resistant and tear-resistant solution-weldable synthetic plastic sheet on said first layer, laying a second pressure-equalising layer of finely ground loose material on top of the synthetic plastic sheet, the layers being formed from refuse slag and/or industrial slag and having a thickness of between about 150 and 500 MM, the loose material having been ground dust-fine before being laid in said layers, and material to be stored is then filled into the pit onto said layers.

2. The method of claim 1, wherein the synthetic plastic sheet is resistant to chemical attack.

3. The method of claim 1, wherein the synthetic plastic sheet is prepared from a plurality of individual sheets by solution welding.

4. The method of claim 1 wherein several horizontal storage layers are disposed above each other.

5. The method of claim 1, wherein the layer thickness of the pressure equalising layers is about 200 to 500 mm.

6. The method of claim 1, wherein the bottom of the pit, which may be levelled, is at least partially foamed over with closed cell foam plastics before said first layer is laid.

* * * * *